US010689911B2

(12) United States Patent
Shields et al.

(10) Patent No.: US 10,689,911 B2
(45) Date of Patent: Jun. 23, 2020

(54) ROLLER CONE EARTH-BORING ROTARY DRILL BITS INCLUDING DISK HEELS AND RELATED SYSTEMS AND METHODS

(71) Applicant: Baker Hughes, a GE company, LLC, Houston, TX (US)

(72) Inventors: Justin Papke Shields, Houston, TX (US); Robert E. Grimes, Houston, TX (US); Rudolf Carl Pessier, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 149 days.

(21) Appl. No.: 15/604,120

(22) Filed: May 24, 2017

(65) Prior Publication Data

US 2017/0342775 A1 Nov. 30, 2017

Related U.S. Application Data

(60) Provisional application No. 62/341,561, filed on May 25, 2016.

(51) Int. Cl.

| | |
|---|---|
| ***E21B 10/12*** | (2006.01) |
| ***E21B 10/18*** | (2006.01) |
| ***E21B 10/50*** | (2006.01) |

(52) U.S. Cl.

CPC ..... *E21B 10/12* (2013.01); *E21B 10/18* (2013.01); *E21B 10/50* (2013.01)

(58) Field of Classification Search

CPC ..... E21B 10/12; E21B 10/18; E21B 10/50

See application file for complete search history.

(56) References Cited

U.S. PATENT DOCUMENTS

| | | | | |
|---|---|---|---|---|
| 2,068,327 A * | 1/1937 | Howard | ..... | E21B 10/12 175/340 |
| 2,533,257 A | 12/1950 | Woods et al. | | |
| 4,174,759 A * | 11/1979 | Arbuckle | ..... | E21B 10/12 175/340 |
| 5,311,958 A | 5/1994 | Isbell et al. | | |
| 6,206,116 B1 | 3/2001 | Saxman | | |
| 6,571,887 B1 * | 6/2003 | Nguyen | ..... | E21B 10/18 175/340 |

(Continued)

FOREIGN PATENT DOCUMENTS

WO 8502223 A1 5/1985

OTHER PUBLICATIONS

International Search Report for International Application No. PCT/US2017/034269 dated Aug. 17, 2017, 3 pages.

(Continued)

*Primary Examiner* — Taras P Bemko
*Assistant Examiner* — Jonathan Malikasim
(74) *Attorney, Agent, or Firm* — TraskBritt

(57) ABSTRACT

Earth-boring rotary drill bits include heel portions exhibiting reduced aggressiveness. Earth-boring rotary drill bits may comprise a bit body and a plurality of roller cones coupled to the bit body. Each roller cone comprises a plurality of rows of cutting elements, and a continuous disk heel located further from an axis of rotation of the roller cone than the at least one row of cutting elements, the continuous disk heel exhibiting a reduced amount of aggressiveness compared to the at least one row of cutting elements.

18 Claims, 8 Drawing Sheets

(56) References Cited

U.S. PATENT DOCUMENTS

| | | | | |
|---|---|---|---|---|
| 6,688,410 | B1 * | 2/2004 | Singh | E21B 10/16 175/339 |
| 7,025,155 | B1 | 4/2006 | Estes | |
| 7,681,670 | B2 | 3/2010 | Centala et al. | |
| 2004/0020693 | A1 * | 2/2004 | Damhof | E21B 10/16 175/352 |
| 2011/0315454 | A1 | 12/2011 | Buske et al. | |
| 2013/0313021 | A1 * | 11/2013 | Zahradnik | E21B 7/00 175/57 |
| 2016/0290052 | A1 * | 10/2016 | Williams | E21B 10/22 |

OTHER PUBLICATIONS

International Written Opinion for International Application No. PCT/US2017/034269 dated Aug. 17, 2017, 7 pages.

* cited by examiner

ROLLER CONE EARTH-BORING ROTARY DRILL BITS INCLUDING DISK HEELS AND RELATED SYSTEMS AND METHODS

CROSS-REFERENCE TO RELATED APPLICATION

This application claims the benefit of U.S. Provisional Patent Application Ser. No. 62/341,561, filed May 25, 2016, and entitled "ROLLER CONE EARTH-BORING ROTARY DRILL BITS INCLUDING DISK HEELS AND RELATED SYSTEMS AND METHODS," the disclosure of which application is hereby incorporated herein in its entirety by this reference.

FIELD

Embodiments of the disclosure relate generally to earth-boring rotary drill bits including one or more roller cones having disk heels and related systems and methods. More particularly, embodiments of the disclosure relate to earth-boring rotary drill bits including one or more roller cones comprising a disk heel portion (e.g., a substantially continuous disk heel) exhibiting reduced aggressiveness relative to other portions of the roller cone and related systems and methods.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit such as, for example, an earth-boring rotary drill bit. Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end and extends into the wellbore from the surface of the formation. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string at the rig floor from the surface, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface down through the center of the drill string, through the hydraulic motor, out from nozzles in the drill bit, and back up to the surface of the formation through the annular space between the outer surface of the drill string and the exposed surface of the formation within the wellbore.

It is known in the art to use what are referred to as "reamer" devices (also referred to in the art as "hole-opening devices" or "hole openers") in conjunction with a drill bit as part of a bottom hole assembly when drilling a wellbore in a subterranean formation. In such a configuration, the drill bit operates as a "pilot" bit to form a pilot bore in the subterranean formation. As the drill bit and bottom hole assembly advance into the formation, the reamer device follows the drill bit through the pilot bore and enlarges the diameter of, or "reams," the pilot bore.

The bodies of earth-boring tools, such as drill bits and reamers, are often provided with fluid courses, such as "junk slots," to allow drilling mud (which may include drilling fluid and formation cuttings generated by the tools that are entrained within the fluid) to pass upwardly around the bodies of the tools into the annular shaped space within the wellbore above the tools outside the drill string.

Some earth-boring rotary drill bits are inherently aggressive and may undesirably damage wellbore components (e.g., surface casing, risers, other tubular members, etc.) with which the earth-boring rotary drill bit inadvertently comes into contact. In addition, some earth-boring rotary drill bits suffer from instability and bit whirl and related vibrations that may damage the bottom hole assembly (BHA) and reduce a cutting efficiency of the earth-boring rotary drill bit.

BRIEF SUMMARY

Embodiments disclosed herein include earth-boring rotary drill bits including at least one roller cone having a reduced-aggressiveness heel portion (e.g., a disk-shaped heel), as well as related systems and methods. For example, in accordance with one embodiment, an earth-boring rotary drill bit comprises a bit body, and a plurality of roller cones coupled to the bit body. Each roller cone of the plurality of roller cones comprises at least one row of cutting elements disposed circumferentially around the roller cone, and a continuous disk heel further from an axis of rotation of the roller cone than the at least one row of cutting elements, the continuous disk heel exhibiting a reduced amount of aggressiveness compared to the at least one row of cutting elements, the continuous disk heel configured to cut and shape a gauge portion of a wellbore.

In additional embodiments, an earth-boring rotary drill bit comprises a bit body, and at least one first roller cone operably coupled to the bit body. The at least one first roller cone comprises a plurality of rows of cutting elements arranged around a circumference of the at least one first roller cone, and a continuous disk heel located further from an axis of rotation of the at least one first roller cone than the plurality of rows of the cutting elements, the continuous disk heel including a radiused portion having a substantially continuous outer diameter.

In yet other embodiments, an earth-boring rotary drill bit comprises a bit body coupled to a threaded section and three roller cones coupled to the bit body. Each roller cone comprises at least one row of cutting teeth and a continuous disk heel having a circumference defined by a substantially uniform outer diameter. The continuous disk heel comprises an inner face substantially perpendicular to an axis of rotation of the roller cone, an outer face, and a radiused portion between the inner face and the outer face.

DETAILED DESCRIPTION

Figure 1:
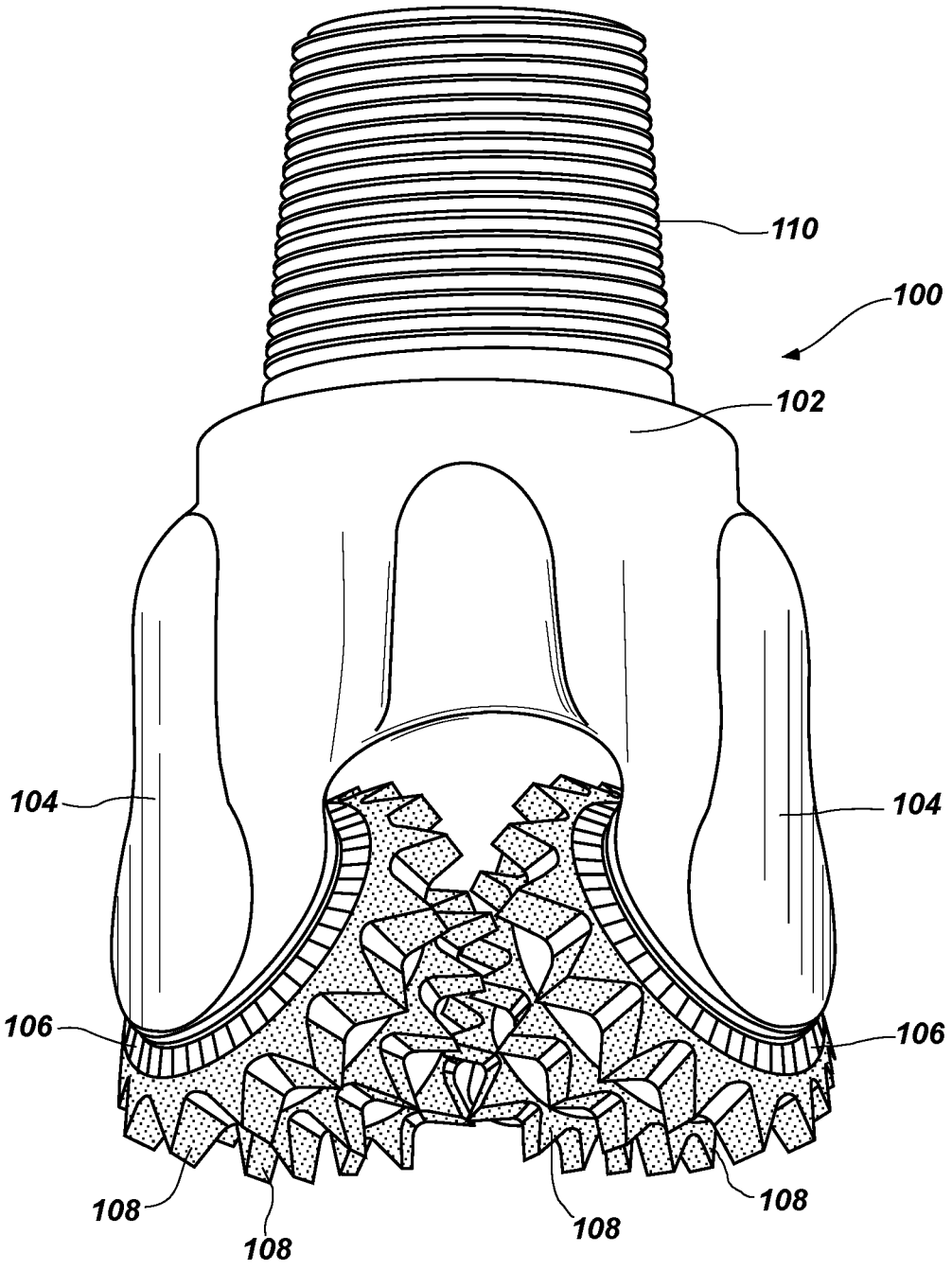
FIG. 1 is a perspective view of an earth-boring rotary drill bit.

Illustrations presented herein are not meant to be actual views of any particular material, component, or system, but are merely idealized representations that are employed to describe embodiments of the disclosure.

The following description provides specific details, such as material types, dimensions, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional fabrication techniques employed in the industry. In addition, the description provided below does not form a complete roller cone earth-boring rotary drill bit including a roller cone comprising at least one continuous disk heel. Only those process acts and structures necessary to understand the embodiments of the disclosure are described in detail below. Additional acts to form a roller cone earth-boring rotary drill bit may be performed by conventional techniques. Also note, drawings accompanying the present application are for illustrative purposes only, and are thus not drawn to scale. Additionally, elements common between figures may retain the same numerical designation.

Hydrocarbon-containing subterranean formations may be accessed at one or more locations to produce hydrocarbons within the subterranean formation. By way of nonlimiting example, an offshore hydrocarbon-containing formation may include a plurality of drilling risers through which the subterranean formation may be accessed. During drilling of the subterranean formation, the drill bit may extend into and undesirably contact one or more risers (e.g., subsea risers) or components of wellbore equipment, damaging the one or more risers or wellbore equipment and potentially negatively affecting the integrity of the associated wellbore. According to some embodiments described herein, a roller cone earth-boring rotary drill bit includes a reduced-aggressiveness portion (e.g., a continuous disk-shaped heel) located proximate (e.g., at) a heel of the earth-boring rotary drill bit. In some embodiments, all of the roller cones of the earth-boring rotary drill bit include a continuous disk-shaped heel. In such an embodiment, the disk-shaped heel may substantially reduce a likelihood of damaging or puncturing risers or wellbore equipment inadvertently contacted by the earth-boring rotary drill bit. Accordingly, an operator may stop advancement of the drill string without substantially damaging the wellbore equipment or the earth-boring rotary drill bit.

The roller cone earth-boring rotary drill bit may include one or more rows of cutting elements to facilitate removal of formation material during drilling operations and advancement of the drill bit while the disk heel at least partially prevents (e.g., substantially prevents) damage to any wellbore equipment that may inadvertently come into contact with the drill bit while removing subterranean formation material proximate a wall of the subterranean formation.

As used herein, the term "wellbore equipment" means and includes any component of wellbore equipment including, for example, a riser, surface casing, a component of a bottom hole assembly (BHA), other tubular members, drilling motors, steering devices, sensor subs, stabilizers, formation evaluation (FE) devices, bidirectional communication and power modules (BCPMs), or other components of a wellbore.

As used herein, an "aggressiveness" of an earth-boring rotary drill bit or of a portion of an earth-boring rotary drill bit means and includes the degree to which portions of the earth-boring rotary drill bit engage a subterranean formation or other material to be crushed, abraded, sheared, cut, or otherwise removed by the earth-boring rotary drill bit. For example, a first portion of an earth-boring rotary drill bit having a higher aggressiveness relative to a second portion of the earth-boring rotary drill bit may engage a surface to be removed with a greater indentation depth than the second portion.

FIG. 1 is a perspective view of an earth-boring rotary drill bit 100 illustrated as a roller cone bit. The earth-boring rotary drill bit 100 may include a bit body 102 having three legs 104 extending from the bit body 102. The earth-boring rotary drill bit 100 may be referred to as a tricone rotary drill bit. The earth-boring rotary drill bit 100 may include a threaded section (e.g., a pin) 110 configured for operably coupling the earth-boring rotary drill bit 100 to one or more sections of tubing of a drill string.

A roller cone 106 may be rotatably mounted to a bearing pin of each of the legs 104, as known in the art. Each roller cone 106 may include a plurality of cutting elements 108 or teeth. Each of the plurality of cutting elements 108 may be machined in exterior surfaces of the bodies of the roller cones 106 and may be integral with the bit body 102. In other embodiments, each of the plurality of cutting elements 108 may comprise separately formed inserts, which may be formed from a wear-resistant material such as cemented tungsten carbide and pressed into recesses in exterior surfaces of the bodies of the roller cones 106 or otherwise secured to the roller cones 106.

According to embodiments described herein, at least some of the cutting elements 108 of the plurality of cutting elements 108 of the roller cones 106 may be replaced with or positioned laterally (e.g., radially) within a circumferential disk heel. Stated another way, the circumferential disk heel may be located at a location that is closer to an axis of rotation of its associated roller cone 106 than the plurality of cutting elements 108 of the roller cone 106 is located. The circumferential disk heel may exhibit a reduced aggressiveness relative to the cutting elements.

Figure 2:
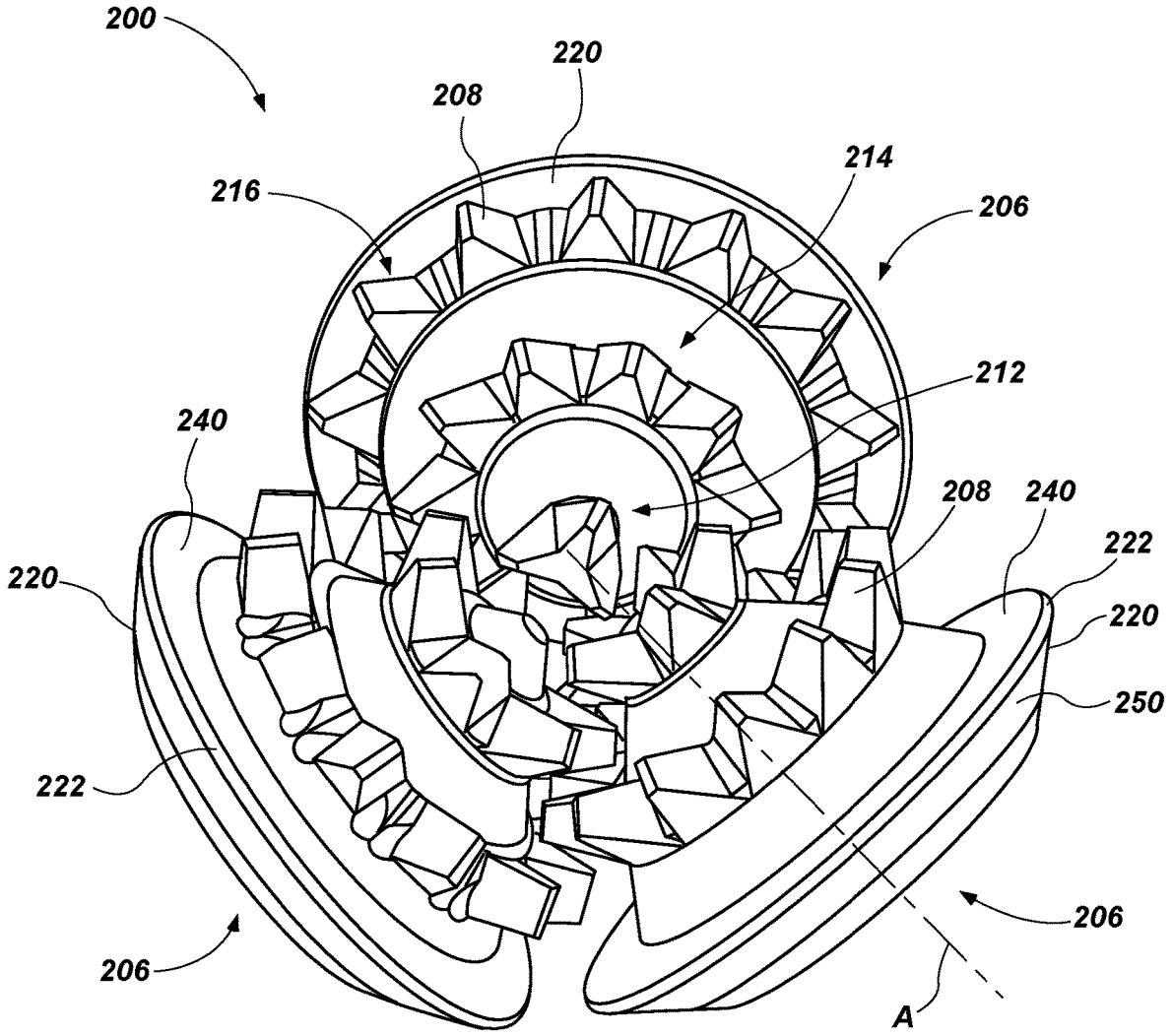
FIG. 2 is a perspective view of a leading face of an earth-boring rotary drill bit, according to embodiments of the disclosure.

FIG. 2 is a perspective view of a leading face of an earth-boring rotary drill bit 200, according to embodiments of the disclosure. The earth-boring rotary drill bit 200 may include roller cones 206, each operably coupled to a different leg of the earth-boring rotary drill bit 200. In some embodiments, the earth-boring rotary drill bit 200 comprises a tricone earth-boring rotary drill bit. In other embodiments, the earth-boring rotary drill bit 200 may comprise fewer or more roller cones 206.

Each roller cone 206 may comprise a plurality of rows of cutting elements 208, the cutting elements 208 disposed circumferentially around the roller cone 206. Each row of cutting elements 208 may include cutting elements 208 located at a different radial distance from an axis of rotation A of the roller cone 206 (also referred to herein as the "axis of cone rotation A") than cutting elements 208 of other rows of cutting elements 208. By way of nonlimiting example, each roller cone 206 may include one or more of a first row (e.g., an apex or nose row) 212 of cutting elements 208, at least one second row (e.g., at least one middle row) 214 of cutting elements 208, and a third row (e.g., a heel (outer) row) 216 of cutting elements 208. In some embodiments, at least one of the roller cones 206 may include a different number of rows of cutting elements 208 than at least another roller cone 206 of the earth-boring rotary drill bit 200.

The cutting elements 208 may be integral with the earth-boring rotary drill bit 200. In some such embodiments, the cutting elements 208 may comprise steel. In other embodiments, the cutting elements 208 may comprise cemented tungsten carbide secured to the earth-boring rotary drill bit 200.

In some embodiments, at least some cutting elements 208 of the first row 212 may be located closer to the rotational axis of the roller cone 206 than at least some cutting elements 208 of the second row 214 or the third row 216. Stated another way, the cutting elements 208 of the first row 212 of cutting elements 208 may be located radially closer to the axis of cone rotation A of the roller cone 206 than the cutting elements 208 of either of the second row 214 or the third row 216 of cutting elements 208.

The third row 216 may comprise an outermost (e.g., located further from the axis of cone rotation A) row of cutting elements 208. Accordingly, the cutting elements 208 of the third row 216 of cutting elements 208 may be located radially further from the axis of rotation A of the roller cone 206 than the cutting elements 208 of the first row 212 or the second row 214. The second row 214 may be disposed between the first row 212 and the third row 216. In some embodiments, some of the roller cones 206 may include only two rows of cutting elements 208 and other of the roller cones 206 may include three rows of cutting elements 208.

Although FIG. 2 illustrates the roller cones 206 as including only two or three rows of cutting elements 208, the disclosure is not so limited and each roller cone 206 may comprise more or fewer rows of cutting elements 208. In addition, in other embodiments, the cutting elements 208 may not be arranged in rows, but may be arranged in other patterns depending on a particular application of the earth-boring rotary drill bit 200. In some embodiments, the first row 212 of cutting elements 208 of one of the roller cones 206 may be located at a different distance from the longitudinal axis of the earth-boring rotary drill bit 200 than the first row 212 of the other roller cones 206. Similarly, the second row 214 of cutting elements 208 and the third row 216 of cutting elements 208 of a first roller cone 206 may be located at a different distance from a longitudinal axis of the earth-boring rotary drill bit 200 than the second row 214 of cutting elements 208 and the third row 216 of cutting elements 208, respectively, of the other roller cones 206.

With continued reference to FIG. 2, each roller cone 206 may comprise a disk heel 220 (e.g., a disk-shaped heel) having a reduced-aggressiveness relative to the cutting elements 208 of the roller cone 206. The disk heel 220 may be located at a location corresponding to a location of a heel row of cutting elements in a roller cone of a conventional earth-boring rotary drill bit and may be configured to cut and shape a gauge portion of a wellbore. The disk heel 220 may be substantially continuous around a circumference thereof (e.g., may comprise a relatively smooth, continuous surface for contacting adjacent structures or downhole components). In some such embodiments, the disk heel 220 may comprise a substantially uniform diameter. Stated another way, a distance from the axis of cone rotation A of the roller cone 206 may be substantially uniform along all portions of a circumference of the disk heel 220. In some embodiments, a circumference of the disk heel 220 comprises a substantially continuous (e.g., uninterrupted) surface and may not include surfaces or portions with an underexposure or overexposure relative to other portions thereof. Accordingly, the disk heel 220 may be free of cutting elements 208 or cutting teeth. In some embodiments, peripheral portions of the disk heel 220 may be located a greater distance from the axis of rotation A of the roller cone 206 than any of the cutting elements 208.

In some embodiments, the disk heels 220 may include a radiused portion 222 (e.g., a rounded, chamfered, arcuate, or beveled portion) on the circumference thereof. The radiused portion 222 may be located at a location more distal from the axis of rotation A of its respective roller cone 206 than other portions of the roller cone 206. In some such embodiments, the radiused portion 222 may be sized and shaped such that the disk heel 220 does not substantially cut or abrade a surface of a hard material (e.g., steel of wellbore components) during use and operation, while effectively removing relatively softer formation materials (e.g., sand, mud, etc., that are typically on the ocean floor or other soft subterranean formations).

The disk heel 220 may be integral with the roller cone 206 and may comprise a same material as each of the cutting elements 208. In some embodiments, the disk heel 220 comprises steel. In other embodiments, the disk heel 220 comprises cemented tungsten carbide. In some embodiments, the disk heel 220 may comprise a material different from a material of the cutting elements 208. In some embodiments, the disk heel 220 may comprise a discontinuous phase including hard particles (e.g., tungsten carbide) dispersed in a continuous phase (e.g., nickel, steel, etc.). In some such embodiments, the disk heel 220 includes a hardfacing material on a surface thereof, such as, for example, a composite material comprising a discontinuous phase including hard particles dispersed throughout a metal or metal alloy matrix material. The matrix material may include, by way of nonlimiting example, cobalt, iron, nickel, copper, titanium, cobalt-based, iron-based, nickel-based, iron- and nickel-based, cobalt- and nickel-based, iron- and cobalt-based, copper-based, and titanium-based alloys and the discontinuous phase may include one or more of a carbide material (e.g., tungsten carbide, titanium carbide, tantalum carbide, silicon carbide), a boride material (e.g., titanium boride), a nitride material (e.g., silicon nitride), non-crystalline diamond grit, or combinations thereof. In yet other embodiments, the disk heel 220 may include tungsten carbide or a polycrystalline diamond material, such as on the radiused portion 222 or on exposed surfaces thereof.

Without wishing to be bound by any particular theory, it is believed that because the disk heel 220 comprises a continuous surface across the circumference thereof rather than cutting teeth as conventional earth-boring rotary drill bits, the disk heel 220 may be less likely to damage components of wellbore equipment (e.g., a riser, tubing, etc.). It is believed that since the disk heel 220 is continuous and does not include any interruptions between teeth in the heel portion as conventional earth-boring rotary drill bits, components of wellbore equipment may not enter a space between interruptions in the disk heel during advancement and are, therefore, not substantially cut, sheared, abraded, or otherwise damaged by the continuous disk heel. In some embodiments, since the disk heel 220 of the earth-boring rotary drill bit 200 comprises a continuous outer surface, components of wellbore equipment inadvertently contacted by the disk heel 220 may bounce or graze off of the disk heel 220.

The radiused portion 222 may be sized and shaped to optimize a weight on bit (WOB) and an aggressiveness of the disk heel 220. By way of nonlimiting example, if the radiused portion 222 is too small (such as if opposing faces of the disk heel 220 converge to a point rather than to the radiused portion 222), the earth-boring rotary drill bit 200 may exhibit an undesired aggressiveness. If the radiused portion 222 is too large, the earth-boring rotary drill bit 200 may exhibit a relatively low rate of penetration, an excessive weight on bit to drill ahead, or both.

The radiused portion 222 may be defined at a location where an inner face 240 and an outer face 250 of the disk heel 220 converge. In some embodiments, the inner face 240 may be oriented substantially perpendicular to the axis A of rotation of the roller cone 206. An angle between the inner face 240 and the outer face 250 may be between about 15° and about 45°, such as between about 15° and about 30°, or between about 30° and about 45°.

In some embodiments, the radiused portion 222 may have a radius of curvature between about 1.5 mm and about 7.0 mm, such as between about 1.5 mm and about 3.0 mm, between about 3.0 mm and about 4.0 mm, between about 4.0 mm and about 5.0 mm, between about 5.0 mm and about 6.0 mm, or between about 6.0 mm and about 7.0 mm. In some embodiments, the radius of curvature of the radiused portion 222 is about 3.175 mm (about 0.125 inch). In other embodiments, the radius of curvature of the radiused portion 222 is about 6.35 mm (about 0.250 inch).

In some embodiments, the disk heels 220 may substantially reduce an aggressiveness of one or more portions of the earth-boring rotary drill bit 200. Accordingly, the earth-boring rotary drill bit 200 may not substantially damage one or more components of wellbore equipment such as steel pipes (e.g., tubular members) responsive to undesirable contact between the disk heels 220 of the earth-boring rotary drill bit 200 and the one or more components of wellbore equipment. Compared to an earth-boring rotary drill bit without the disk heels 220 (and including cutting elements 208 located at positions corresponding to a position of the disk heels 220) that tend to damage (e.g., cut, abrade) structures in which the earth-boring rotary drill bit 200 comes into contact with, the earth-boring rotary drill bit 200 may not substantially damage or puncture (e.g., dig into) surfaces of components of wellbore equipment. Accordingly, the earth-boring rotary drill bit 200 including the roller cones 206 having the disk heels 220 may substantially reduce a likelihood of inadvertently damaging wellbore equipment. In addition, the inner rows of cutting elements 208 (e.g., the first row 212 and the second row 214) may facilitate sufficient cutting to allow the earth-boring rotary drill bit 200 to drill soft formations and soft materials to complete a section of a wellbore.

The cutting elements 208 may be shaped and configured to remove materials having a higher hardness (e.g., a Brinell Hardness) than the disk heels 220. Accordingly, portions of the earth-boring rotary drill bit 200 including the disk heels 220 may exhibit a reduced aggressiveness relative to the portions of the earth-boring rotary drill bit 200 including the cutting elements 208. In other words, the disk heels 220 may exhibit a reduced tendency to gauge, abrade, scar, perforate, or otherwise damage surfaces of a material having a hardness higher than a hardness of conventional shale materials (e.g., a hardness greater than about 100 BHN (Brinell Hardness)).

In some embodiments, the earth-boring rotary drill bit 200 may be configured to remove soft formation material (e.g., sandstone, clay, shale, etc.), such as formation materials that may be encountered offshore or underwater, without balling (e.g., where the subterranean formation material becomes lodged between teeth of the earth-boring rotary drill bit). Since the disk heel 220 comprises a continuous cutting surface that does not include teeth, removed formation materials may not agglomerate and lodge proximate the disk heel 220. The disk heel 220 may exhibit a substantial hardness to remove material from subterranean formations comprising so-called "soft" materials while not substantially damaging wellbore equipment inadvertently contacted by the disk heel 220.

Accordingly, the disk heels 220 may decrease an aggressiveness of the earth-boring rotary drill bit 200 while the cutting elements 208 of the rows of cutting elements 208 located closer to the axis A of rotation of the roller cone 206 than the disk heels 220 (e.g., the first row 212 and the second row 214) facilitate drilling through soft formations at a suitable rate of penetration. In some embodiments, the disk heels 220 may provide a reduced aggressiveness to an outer portion of the earth-boring rotary drill bit 200. For example, an outer circumference or outer lateral portion of the earth-boring rotary drill bit 200 (e.g., the radiused portion 222) may lack cutting elements in order to protect structures that the earth-boring rotary drill bit 200 may contact during operation.

Figure 3A:
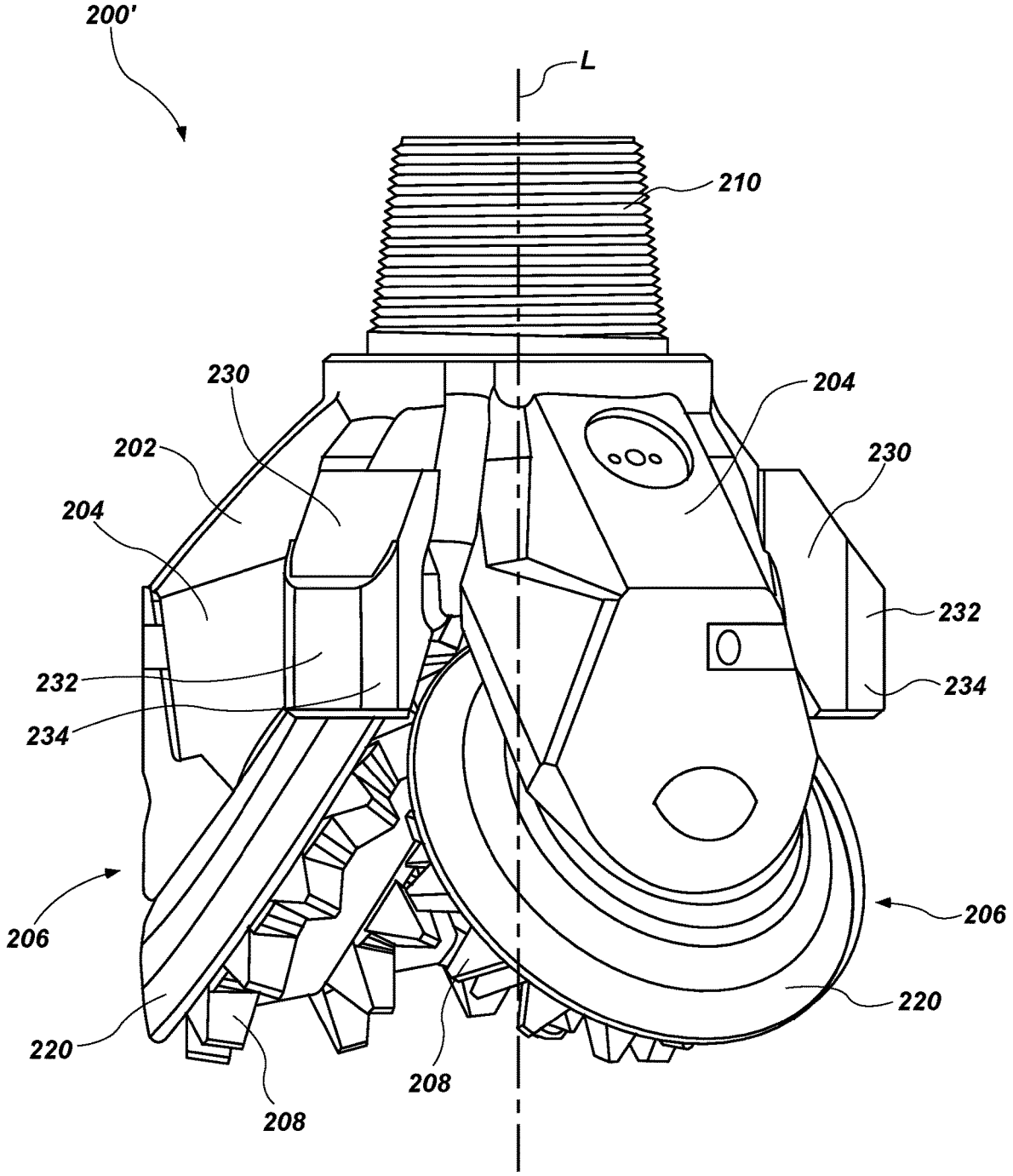
FIG. 3A is a side view of an earth-boring rotary drill bit, according to embodiments of the disclosure.
Figure 3B:
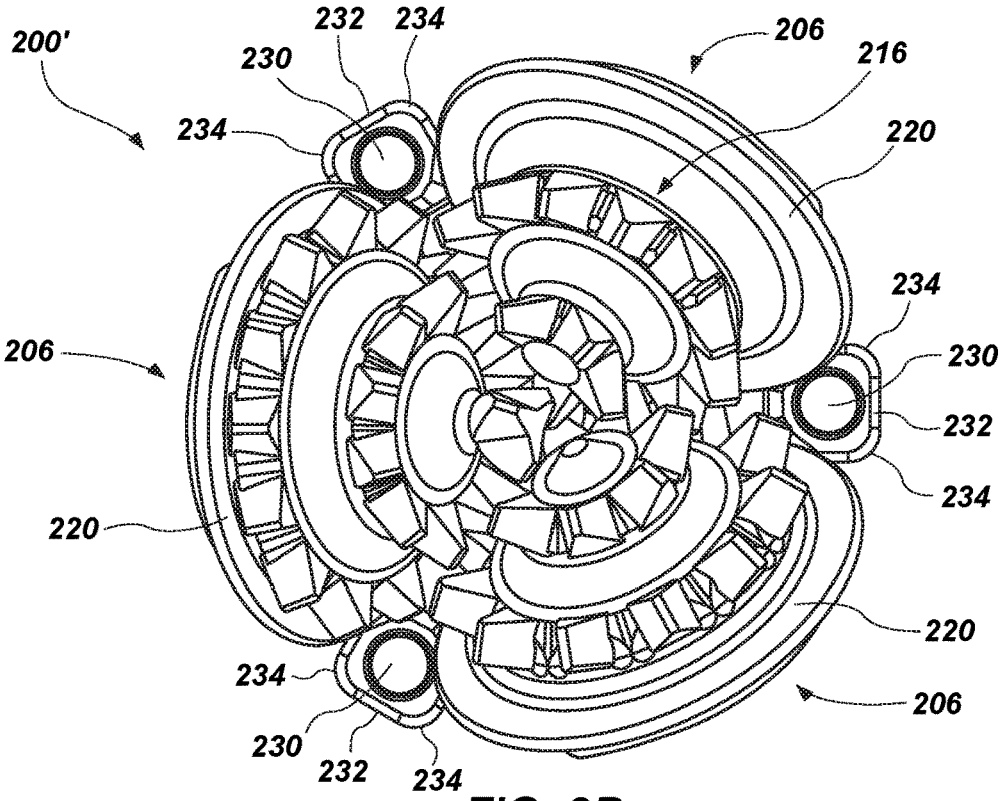
FIG. 3B is a face view of the earth-boring rotary drill bit of FIG. 3A.

In some embodiments, the earth-boring rotary drill bit 200 may include nozzle extensions (e.g., nozzle extension housings that may house, for example, tungsten carbide nozzles) configured and positioned to increase a stabilization of the earth-boring rotary drill bit 200 during drilling operations. FIG. 3A and FIG. 3B are respective perspective and face views of an earth-boring rotary drill bit 200' according to another embodiment of the disclosure. The earth-boring rotary drill bit 200' may include a threaded section 210 configured to operably couple the earth-boring rotary drill bit 200' to one or more sections of a drill string. Bit legs 204 may depend from a bit body 202 of the earth-boring rotary drill bit 200'. The roller cones 206 may be rotatably secured to a bearing shaft (not shown) of each of the bit legs 204. By way of nonlimiting example, the earth-boring rotary drill bit 200' may include three roller cones 206, one of which is obscured from view in the perspective of FIG. 3A. Each roller cone 206 may comprise cutting elements 208, as described with reference to FIG. 2.

The earth-boring rotary drill bit 200' may be substantially similar to the earth-boring rotary drill bit 200 described with reference to FIG. 2, but may include at least one fluid delivery nozzle extension 230 coupled to the bit body 202 and housing a fluid delivery nozzle configured to control a direction and velocity of pressurized drilling fluid flowing through the bit body 202 and out from the nozzle during drilling operations. In some embodiments, the fluid delivery nozzle extension 230 may house a semi-extended high flow nozzle and be configured to be operably coupled (e.g., secured) to the bit body 202. In other embodiments, the fluid delivery nozzle extension 230 may be integral with the bit body 202.

The fluid delivery nozzle extension 230 may be coupled to the earth-boring rotary drill bit 200' at locations between adjacent roller cones 206. In some embodiments, the earth-boring rotary drill bit 200' includes a same number of fluid delivery nozzle extensions 230 as roller cones 206. In some embodiments, the earth-boring rotary drill bit 200' includes three fluid delivery nozzle extensions 230. In some embodiments, the fluid delivery nozzle extensions 230 may between about 0.5 mm and about 3.0 mm undergauge.

In some embodiments, an exposed (e.g., outer) surface of the fluid delivery nozzle extension 230 may comprise a hardfacing material 232. The hardfacing material 232 may comprise hardfacing materials that are known in the art and are, therefore, not described in detail herein. By way of nonlimiting example, the hardfacing material 232 may comprise a composite material including at least one phase that exhibits a relatively high hardness and another phase that exhibits a relatively high fracture toughness. The hardfacing material 232 may comprise a discontinuous phase including hard particles dispersed throughout a metal or metal alloy matrix material. The matrix material may include, by way of nonlimiting example, cobalt, iron, nickel, copper, titanium, cobalt-based, iron-based, nickel-based, iron- and nickel-based, cobalt- and nickel-based, iron- and cobalt-based, copper-based, and titanium-based alloys and the discontinuous phase may include one or more of a carbide material (e.g., tungsten carbide, titanium carbide, tantalum carbide, silicon carbide), a boride material (e.g., titanium boride), a nitride material (e.g., silicon nitride), non-crystalline diamond grit, or combinations thereof.

In some embodiments, each fluid delivery nozzle extension 230 may include a radiused portion 234 (e.g., rounded, chamfered, or beveled), between sides thereof. A rotationally leading edge and a rotationally trailing edge of each nozzle extension 230 may include the radiused portion 234. In some embodiments, the radiused portion 234 may substantially reduce potential damage to wellbore equipment inadvertently contacted by the earth-boring rotary drill bit 200' during drilling operations. By way of nonlimiting example, the radiused portion 234 may facilitate bouncing off of the earth-boring rotary drill bit 200' if the earth-boring rotary drill bit 200' undesirably contacts a component of wellbore equipment.

In some embodiments, the radiused portion 234 may have a radius of curvature between about 3 mm and about 10 mm, such as between about 3 mm and about 4 mm, between about 4 mm and about 5 mm, between about 5 mm and about 7 mm, or between about 7 mm and about 10 mm.

In some embodiments, the fluid delivery nozzle extension 230 may be positioned and configured such that a portion of the hardfacing material 232 located most distal from a longitudinal axis L of the earth-boring rotary drill bit 200' is proximate a gauge surface of the earth-boring rotary drill bit 200'. Stated another way, a radial distance from the longitudinal axis L to the distal portion of the hardfacing material 232 may be equal to about a radial distance from the longitudinal axis to gauge surfaces of the earth-boring rotary drill bit 200'.

Figure 3C:
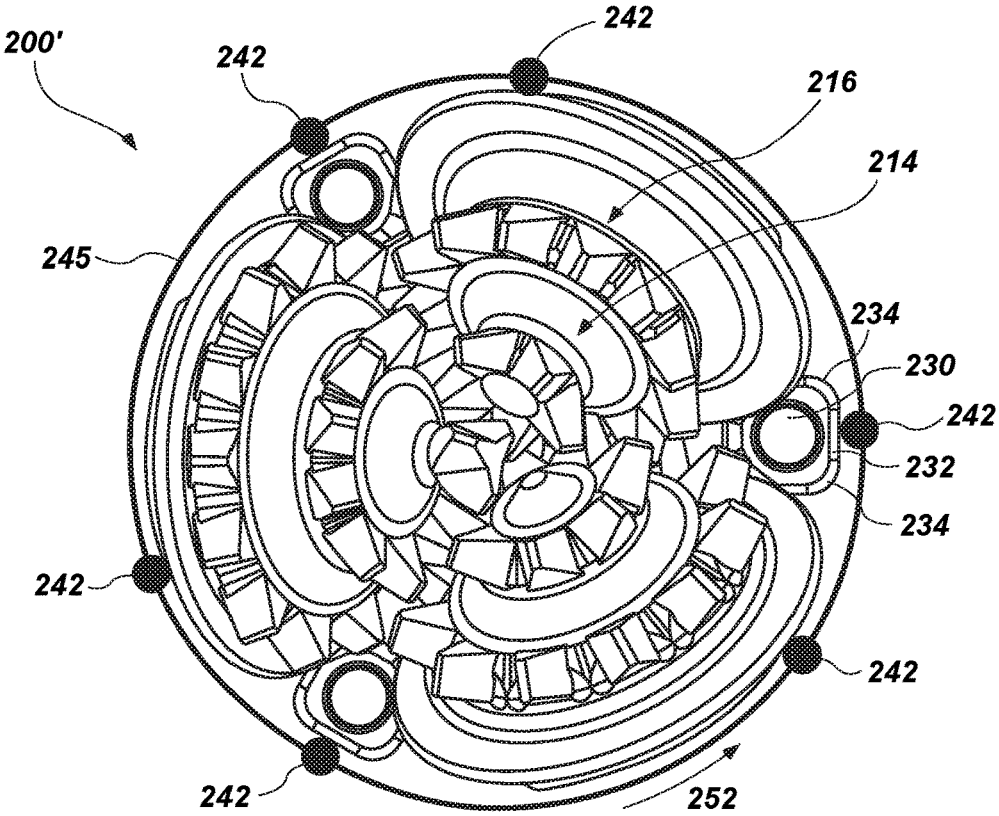
FIG. 3C is another face view of the earth-boring rotary drill bit of FIG. 3A and FIG. 3B schematically illustrating outermost portions of the earth-boring rotary drill bit.

As illustrated in FIG. 3B and FIG. 3C, the fluid delivery nozzle extension 230 may be positioned and configured to reduce a chordal drop (i.e., a maximum distance between a gauge surface (i.e., a wall of a borehole) and the outer surface of the roller cone 206) of the earth-boring rotary drill bit 200'. In general, a high chordal drop between adjacent roller cones 206 may increase an amount that an undesired material (e.g., tubular components or wellbore equipment) may enter regions between the roller cones 206 during drilling operations. In other words, a high chordal drop may correspond to a relatively larger distance between an outer cutting profile 245 and a surface of the earth-boring rotary drill bit 200'. Accordingly, the fluid delivery nozzle extension 230 may be positioned and configured to fill voids within a circular cross section of the earth-boring rotary drill bit 200' between bit legs 204 of the earth-boring rotary drill bit 200' such that at least a majority of the outer lateral or radial portion of the earth-boring rotary drill bit 200' exhibits a substantially continuous surface about a circumference of the earth-boring rotary drill bit 200'.

In some embodiments, the location of the fluid delivery nozzle extension 230 may increase a stabilization of the earth-boring rotary drill bit 200' and reduce bit bounce and drill string vibrations during use and operation of the earth-boring rotary drill bit 200'. During rotation of the earth-boring rotary drill bit 200', the location of the fluid delivery nozzle extension 230 directly between adjacent roller cones 206 may reduce a degree to which undesired materials (e.g., tubular components) may enter a cutting zone of the earth-boring rotary drill bit 200'. The fluid delivery nozzle extension 230, including the hardfacing material 232 and the radiused portion 234, may facilitate so called "glancing off" of the earth-boring rotary drill bit 200' from surfaces the wellbore or wellbore equipment without substantially damaging such materials.

FIG. 3C is a face view of the earth-boring rotary drill bit 200' of FIG. 3A and FIG. 3B schematically illustrating an outer cutting profile 245 of the earth-boring rotary drill bit 200'. During rotation of the earth-boring rotary drill bit 200', a direction of which is indicated by arrow 252, portions of the earth-boring rotary drill bit 200' located more distal from the longitudinal axis L (FIG. 3A) of the earth-boring rotary drill bit 200' may contact structures before other portions of the earth-boring rotary drill bit 200', as indicated at points 242, which are on the gauge circle. In other words, the points 242 may define a diameter of a hole drilled by the earth-boring rotary drill bit 200'. The tricone earth-boring rotary drill bit 200' illustrated in FIG. 3C may include about six such points 242, as indicated at 242 because of the fluid delivery nozzle extensions 230, and the gauge cutting portion of the three roller cones 206, as indicated at points 242. By way of comparison, an earth-boring rotary drill bit without the fluid delivery nozzle extensions 230 may include only three such points and may, therefore, exhibit a greater chordal drop than the earth-boring rotary drill bit 200'. Since the earth-boring rotary drill bit 200' includes six contact points 242 on the gauge of a diameter drilled by the earth-boring rotary drill bit 200', the earth-boring rotary drill bit 200' may exhibit a relatively lower chordal drop compared to a conventional earth-boring rotary drill bit 200 not including the fluid delivery nozzle extensions 230 between roller cones.

Figure 4:
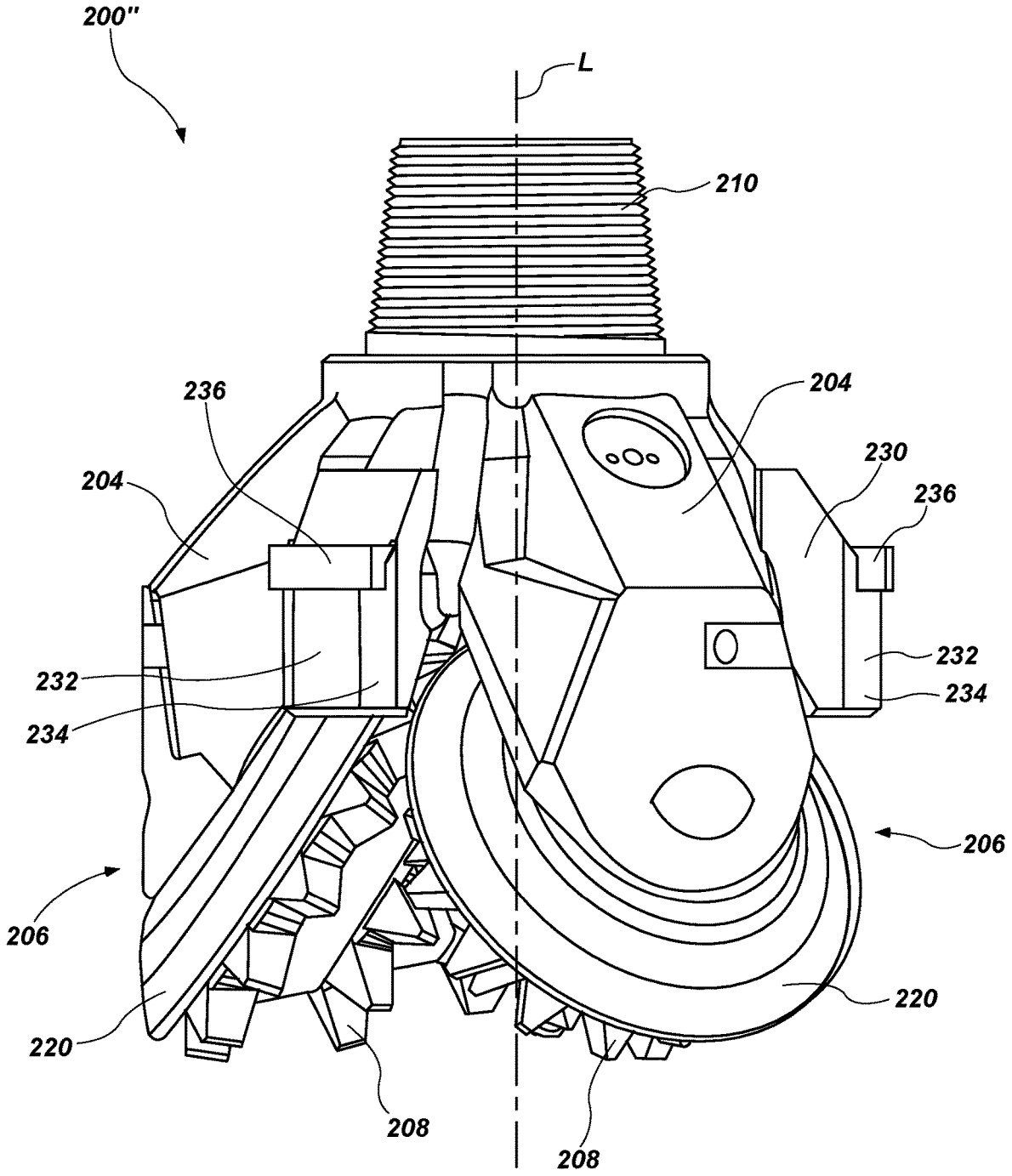
FIG. 4 is a side view of an earth-boring rotary drill bit, according to embodiments of the disclosure.

FIG. 4 is a side view of an earth-boring rotary drill bit 200" according to another embodiment of the disclosure.

The earth-boring rotary drill bit 200" may be substantially similar to the earth-boring rotary drill bit 200' described with reference to FIG. 3A through FIG. 3C above, except that the earth-boring rotary drill bit 200" may include gauge pads 236. In some embodiments, the gauge pads 236 may be coupled to (e.g., secured to) the fluid delivery nozzle extension 230, such as to the hardfacing material 232 of the fluid delivery nozzle extension 230. The gauge pads 236 may be located further from the longitudinal axis L than the hardfacing material 232. In some embodiments, the gauge pads 236 may be located at substantially a same radial distance from the longitudinal axis L as the disk heel 220.

The gauge pads 236 may comprise a material configured to scar or wear responsive to contact with a component of wellbore equipment, such as a component comprising steel. In some embodiments, the gauge pads 236 may comprise a material that is relatively softer than materials of the wellbore (e.g., steel). By way of nonlimiting example, the gauge pads 236 may comprise a copper material, a bronze material, an aluminum material, or combinations thereof. In some embodiments, the gauge pads 236 comprise a bronze material. In some embodiments, the gauge pads 236 comprise a nonferrous material.

Responsive to engaging a material having a higher hardness than a hardness of the gauge pads 236, the gauge pads 236 may scar. In some embodiments, a steel material of wellbore equipment may scrape onto the gauge pads 236, leaving a residue of the steel material embedded within the relatively softer material of the gauge pads 236. During use and operation, a drill string including the earth-boring rotary drill bit 200" comprising the gauge pads 236 may be pulled out of a wellbore (e.g., tripped) and inspected to determine whether the earth-boring rotary drill bit 200" encountered hard materials of wellbore components (e.g., steel) during the drilling operation by examining defects formed in the gauge pads 236.

Figure 5:
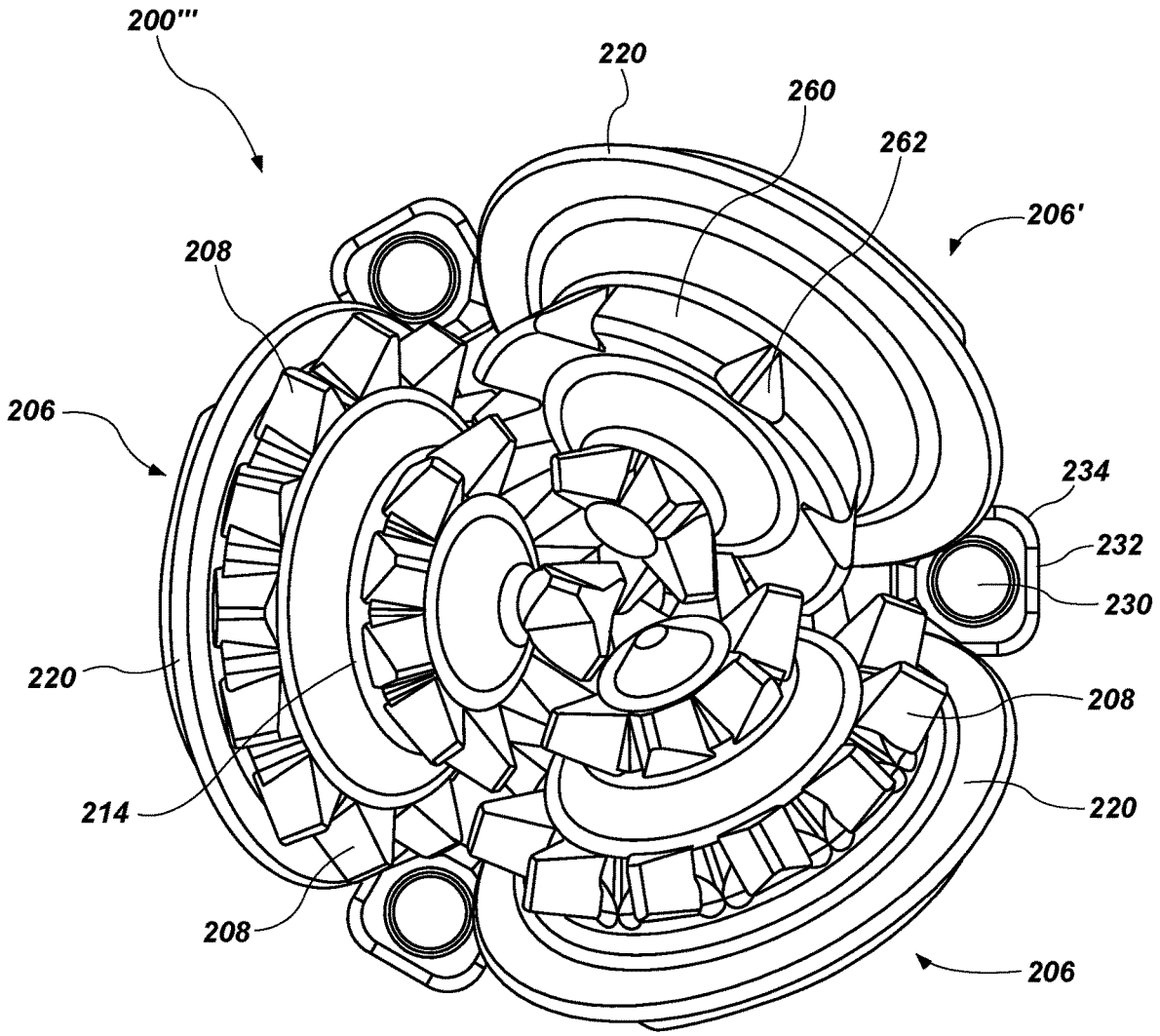
FIG. 5 is a face view of an earth-boring rotary drill bit, according to embodiments of the disclosure.

FIG. 5 is a face view of an earth-boring rotary drill bit 200'" according to other embodiments of the disclosure. The earth-boring rotary drill bit 200'" may be substantially the same as the earth-boring rotary drill bit 200' or the earth-boring rotary drill bit 200" described above with reference to FIG. 3A through FIG. 4, except that the earth-boring rotary drill bit 200'" may include at least one roller cone 206' comprising at least two disk-shaped portions (e.g., to further reduce the aggressiveness of the at least one roller cone 206'). The roller cone 206' may include the disk heel 220 as previously described and may further include another circumferential disk 260 located closer to an axis of rotation of the roller cone 206' than the disk heel 220.

In some embodiments, the circumferential disk 260 may include cutout portions 262. The circumferential disk 260 may comprise an interrupted disk, wherein the cutout portions 262 interrupt a substantially continuous outer diameter of the circumferential disk 260. In some embodiments, the circumferential disk 260 may include fewer cutout portions 262 than a number of cutting elements 208 of a corresponding middle row of cutting elements 208 of the other roller cones 206.

The circumferential disk 260 may be configured to reduce an aggressiveness of the roller cone 206' compared to the roller cones 206 including rows of cutting elements 208 (e.g., one or more middle rows of cutting elements 208). The cutout portions 262 may provide a discontinuity in the circumferential disk 260 and may increase an aggressiveness of the circumferential disk 260 relative to the disk heel 220. In some embodiments, the cutout portions 262 may reduce balling or agglomeration of formation cuttings. In some embodiments, a distance between adjacent cutout portions 262 of the circumferential disk 260 may be greater than a distance between adjacent cutting elements 208 of a corresponding row of the other roller cones 206.

In other embodiments, the circumferential disk 260 may not include the cutout portions 262 and may be substantially continuous, similar to the disk heels 220. In some such embodiments, at least one of the roller cones 206' may comprise two continuous disk portions (e.g., the disk heel 220 and the continuous circumferential disk 260) while at least another roller cone 206 comprises a single continuous disk heel 220.

The circumferential disk 260 may extend downward (e.g., axially downward) along a longitudinal axis of the earth-boring rotary drill bit 200'" farther than other portions of the earth-boring rotary drill bit 200'" (e.g., defining an axially distalmost portion of the rotary drill bit 200'"). In other words, at least a portion of the circumferential disk 260 may be located further from a threaded section (e.g., threaded section 210 (FIG. 3A) than other portions of the roller cone 206' and roller cones 206). Accordingly, during use and operation, the circumferential disk 260 may contact a formation or other structure in front of the earth-boring rotary drill bit 200'" as the earth-boring rotary drill bit 200'" is advanced in a wellbore. By way of nonlimiting example, if the earth-boring rotary drill bit 200'" contacts a component of a horizontal leg of a wellbore, the circumferential disk 260 may substantially reduce an amount of damage to the wellbore component compared to earth-boring rotary drill bits without a leading circumferential disk 260.

Although FIG. 5 illustrates only one roller cone 206' including the disk heel 220 and the circumferential disk 260, the disclosure is not so limited and more than one roller cone 206 may include the circumferential disk 260. In other embodiments, at least two roller cones 206 may include the circumferential disk 260. In yet other embodiments, all of the roller cones 206 may include the circumferential disk 260.

Figure 6:
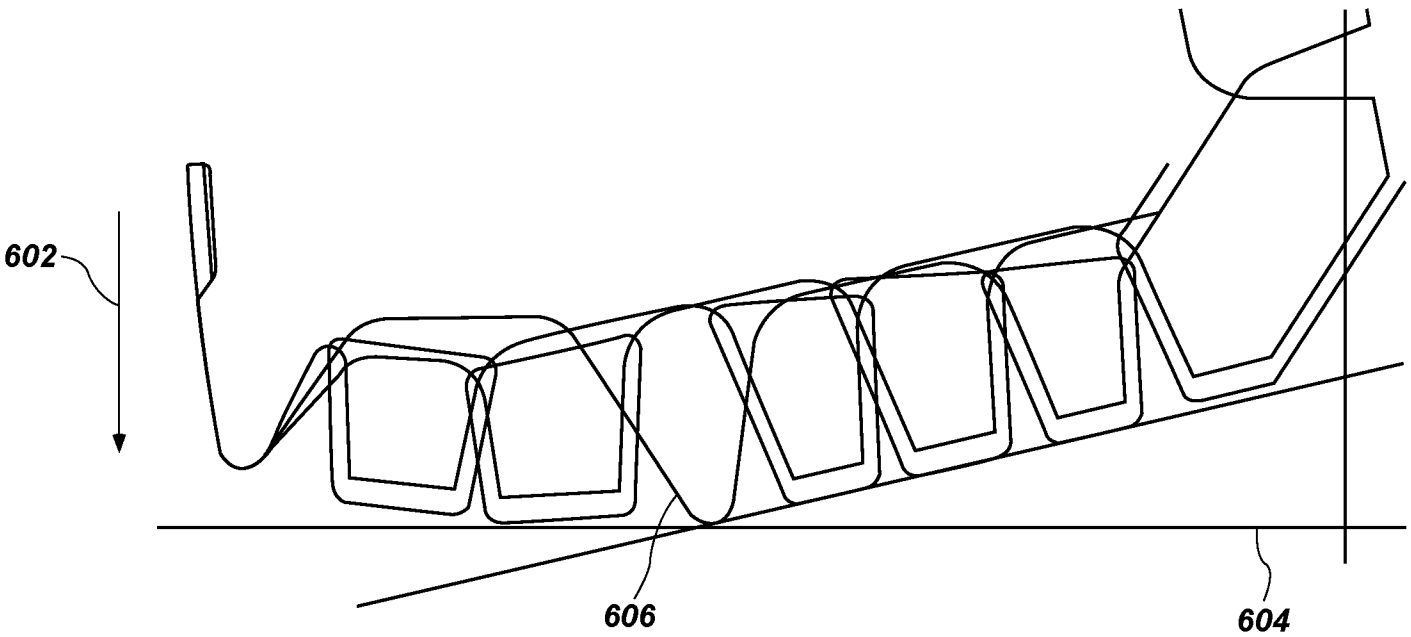
FIG. 6 is a cutting element profile of the earth-boring rotary drill bit of FIG. 5.

FIG. 6 is a cutting element profile of the earth-boring rotary drill bit 200'" of FIG. 5. The earth-boring rotary drill bit 200'" may extend into a formation in a direction indicated by arrow 602. During operation, the earth-boring rotary drill bit 200'" may advance into the formation toward a structure, represented by line 604. The structure may extend in a direction substantially perpendicular to the direction in which the earth-boring rotary drill bit 200'" is advanced into the formation. Line 606 represents a cutting element profile of the circumferential disk 260. As shown in FIG. 6, during advancement of the earth-boring rotary drill bit 200'" in the formation, the circumferential disk 260 may be the first portion of the earth-boring rotary drill bit 200'" to contact the structure. Responsive to contacting the structure, the earth-boring rotary drill bit 200'" may bounce off of the structure rather than cutting or digging into the structure as may a roller cone with cutting elements located at the locations corresponding to the disk heel 220. Although FIG. 6 illustrates the structure extending perpendicular to the direction the earth-boring rotary drill bit 200'" extends into the formation, the disclosure is not so limited. In some embodiments, the earth-boring rotary drill bit 200'" may be useful in reducing damage to wellbore components (e.g., risers) extending parallel to or at an acute angle relative to the earth-boring rotary drill bit 200'". In some such embodiments, the disk heel 220 may reduce damage to wellbore components inadvertently contacted by the earth-boring rotary drill bit 200'".

Figure 7:
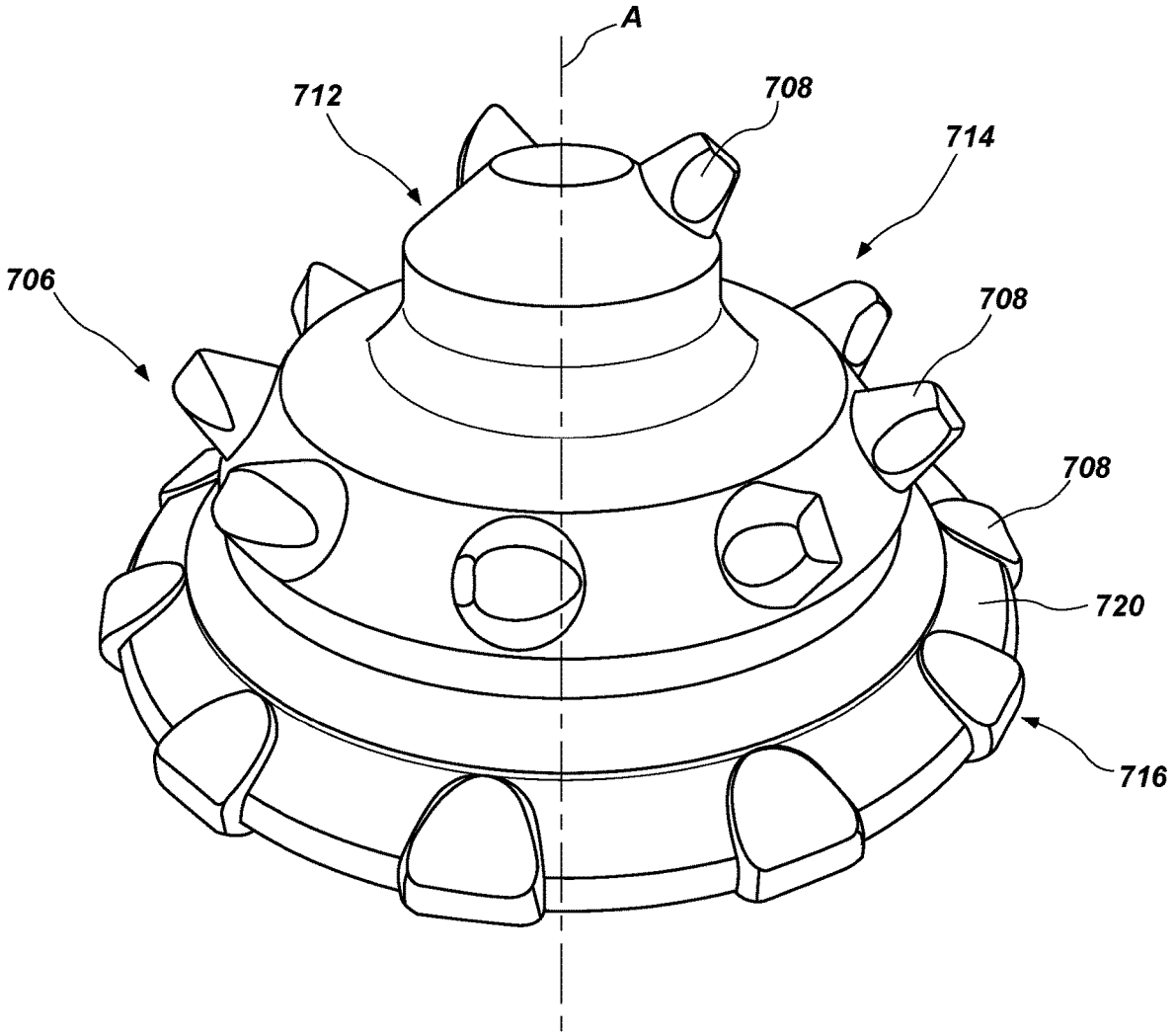
FIG. 7 is a perspective view of a portion of a tungsten carbide insert (TCI) roller cone according to embodiments of the disclosure.

FIG. 7 is a perspective view of a portion of a tungsten carbide insert type (TCI) roller cone 706 according to other embodiments of the disclosure. The TCI roller cone 706 may include a plurality of rows of cutting elements 708, including, for example, a first row 712, a second row 714, and a third row 716. The third row 716 may be located further from an axis of rotation A of the TCI roller cone 706 than the first row 712 and the second row 714. The third row 716 may include a plurality of cutting elements 708 and spaced along a disk heel 720. In some embodiments, the cutting elements 708 in the third row 716 extend further from the axis of rotation A than a circumference of the disk heel 720. In some such embodiments, the cutting elements 708 of the disk heel 720 may have an exposure between about 2.0 mm and about 5.0 mm, such as between about 2.0 mm and about 2.5 mm, between about 2.5 mm and about 3.0 mm, between about 3.0 mm and about 4.0 mm, or between about 4.0 mm and about 5.0 mm. In some embodiments, an exposure of the cutting elements 708 of the disk heel 220 may be less than about 2.54 mm (about 0.100 inch). In some embodiments, an exposure of the cutting elements 708 of the third row 716 may be substantially less than an exposure of the cutting elements 708 of the first row 712 and the second row 714.

In other embodiments, the cutting elements 708 in the third row 716 may extend about a same distance from the central axis A as the circumference of the disk heel 720. Accordingly, the cutting elements 708 of the disk heel 720 may exhibit a reduced amount of aggressiveness relative to the other cutting elements 708 in order to at least partially limit damage to adjacent structures, as discussed above.

Although the earth-boring rotary drill bits 200, 200', 200", and 200''' described herein have been described as roller cone earth-boring rotary drill bits, the disclosure is not so limited. In some embodiments, the earth-boring rotary drill bit may comprise, for example, a hybrid earth-boring rotary drill bit including at least one fixed blade and fixed cutters and at least one roller cone having a disk heel 220 or any other drill bit implementing a rotating cutting portion.

While embodiments of the disclosure may be susceptible to various modifications and alternative forms, specific embodiments have been shown by way of example in the drawings and have been described in detail herein. However, it should be understood that the disclosure is not limited to the particular forms disclosed. Rather, the disclosure encompasses all modifications, variations, combinations, and alternatives falling within the scope of the disclosure as defined by the following appended claims and their legal equivalents.

What is claimed is:

1. An earth-boring rotary drill bit, comprising:
a bit body; and
a plurality of roller cones coupled to the bit body, each roller cone of the plurality of roller cones comprising:
at least one row of cutting elements disposed circumferentially around the roller cone; and
a continuous disk heel located farther from an axis of rotation of the roller cone than the at least one row of cutting elements, the continuous disk heel comprising an uninterrupted surface free of cutting elements and exhibiting a reduced amount of aggressiveness compared to the at least one row of cutting elements, the continuous disk heel configured to cut and shape a gauge portion of a wellbore.

2. The earth-boring rotary drill bit of claim 1, wherein each continuous disk heel comprises a radiused portion located farther from the axis of rotation of its respective roller cone than other portions of the roller cone.

3. The earth-boring rotary drill bit of claim 2, wherein the radiused portion comprises a radius of curvature between about 1.5 mm and about 7.0 mm.

4. The earth-boring rotary drill bit of claim 1, further comprising at least one gauge pad located at substantially a same radial distance from a longitudinal axis of the earth-boring rotary drill bit as the continuous disk heel.

5. The earth-boring rotary drill bit of claim 4, wherein the at least one gauge pad comprises a bronze material, an aluminum material, or a combination thereof.

6. The earth-boring rotary drill bit of claim 1, further comprising a plurality of nozzle extensions coupled to the bit body, each nozzle extension disposed between adjacent roller cones of the plurality of roller cones.

7. The earth-boring rotary drill bit of claim 6, wherein each nozzle extension of the plurality of nozzle extensions is between about 0.5 mm and about 3.0 mm undergauge.

8. The earth-boring rotary drill bit of claim 6, further comprising a hardfacing material over exposed surfaces of each nozzle extension.

9. The earth-boring rotary drill bit of claim 8, wherein the hardfacing material comprises a radiused portion at a rotationally leading edge of its respective nozzle extension and a radiused portion at a rotationally trailing edge of the respective nozzle extension.

10. The earth-boring rotary drill bit of claim 1, wherein the continuous disk heel comprises steel.

11. An earth-boring rotary drill bit, comprising:
a bit body; and
a plurality of roller cones operably coupled to the bit body, each roller cone of the plurality of roller cones comprising:
at least one row of cutting elements arranged around a circumference of the respective roller cone of the plurality of roller cones; and
a continuous disk heel located farther from an axis of rotation of the respective roller cone of the plurality of roller cones than the at least one row of cutting elements, the continuous disk heel including a radiused portion having a substantially continuous outer diameter free of cutting elements and exhibiting a reduced aggressiveness relative to the at least one row of cutting elements, wherein the substantially continuous outer diameter free of cutting elements of the continuous disk heel comprises an uninterrupted surface free of cutting elements.

12. The earth-boring rotary drill bit of claim 11, wherein one of the roller cones of the plurality of roller cones comprises a circumferential disk located radially farther from a rotational axis of the one of the roller cones than the at least one row of cutting elements, the continuous disk heel of the one of the roller cones located farther from the rotational axis of the one of the roller cones than the circumferential disk.

13. The earth-boring rotary drill bit of claim 12, wherein the circumferential disk comprises a substantially continuous circumference.

14. The earth-boring rotary drill bit of claim 12, wherein the circumferential disk comprises an interrupted circumference including at least one cutout portion.

15. An earth-boring rotary drill bit, comprising:
a bit body coupled to a threaded section; and
three roller cones coupled to the bit body, each roller cone comprising:
at least one row of cutting elements; and
a continuous disk heel having a circumference defined by a substantially uniform outer diameter comprising an uninterrupted surface free of cutting elements and exhibiting a reduced amount of aggressiveness relative to the at least one row of cutting elements, the circumference of the continuous disk heel located farther from an axis of rotation of its respective roller cone than the at least one row of cutting elements, the continuous disk heel comprising:

an exposed inner face substantially perpendicular to an axis of rotation of the roller cone;

an exposed outer face free of cutting elements; and a radiused portion between the exposed inner face and the exposed outer face.

16. The earth-boring rotary drill bit of claim 15, wherein the radiused portion has a radius of curvature between about 1.5 mm and about 7.0 mm.

17. The earth-boring rotary drill bit of claim 15, wherein an angle between the inner face and the outer face is between about 15° and about 45°.

18. The earth-boring rotary drill bit of claim 15, wherein the continuous disk heel comprises steel.

* * * * *